US005584351A

United States Patent [19]

Ellicott

[11] Patent Number: 5,584,351

[45] Date of Patent: Dec. 17, 1996

[54] DRILLING MACHINE AND METHOD OF HORIZONTAL BORING

[75] Inventor: John Ellicott, Devon, United Kingdom

[73] Assignee: Avon Lippiat Hobbs (Contracting) Limited, Westbury, England

[21] Appl. No.: 212,170

[22] Filed: Mar. 11, 1994

[30] Foreign Application Priority Data

Mar. 13, 1993 [GB] United Kingdom ..... 9305236

[51] Int. Cl.[6] ..... E21B 6/00; E21B 7/02; E21B 19/20

[52] U.S. Cl. ..... 175/62; 175/52

[58] Field of Search ..... 175/52, 62; 299/55, 299/68

[56] References Cited

U.S. PATENT DOCUMENTS

| | | | |
|---|---|---|---|
| 2,655,117 | 1/1954 | Ivey | 175/62 X |
| 2,752,122 | 6/1956 | Hyatt et al. | 175/62 X |

FOREIGN PATENT DOCUMENTS

| | | | |
|---|---|---|---|
| 647763 | 9/1962 | Canada | 175/62 |
| 213584 | 8/1990 | Japan | 175/62 |

*Primary Examiner*—David J. Bagnell
*Attorney, Agent, or Firm*—Davis and Bujold

[57] ABSTRACT

A drilling machine for horizontal boring comprising a chassis, a thrust chamber, a prime mover enabling a drill connection to transmit driving power to a drilling head by way of a plurality of drill rods, a magazine for housing singular drill rods, and transfer means for moving a drill rod from the magazine to one end of the drill connection. Also disclosed is a method of drilling a horizontal bore comprising the steps of excavating a trench, locating a self propelled chassis over the trench, lowering a thrust chamber into the trench, energizing a drill head by way of a drill connection comprising at least one drill rod, urging the drill head forwardly along the bore, transferring a further drill rod to the drill connection thereby extending the drill connection, and urging the drill head forwardly again along the bore.

2 Claims, 2 Drawing Sheets

DRILLING MACHINE AND METHOD OF HORIZONTAL BORING

FIELD OF THE INVENTION

This invention relates to a method of, and apparatus for, drilling a generally horizontal bore. The term 'generally horizontal' is used to here to distinguish a bore for a utility such as water and gas supply and communication cables from a 'generally vertical' bore such as is used in recovering gas and oil from underground wells thereof.

BACKGROUND OF THE INVENTION

Until recently the standard method of laying generally horizontal pipes and conduits for utilities such as water, gas, electricity and telecommunications was to dig a trench, lay the pipe into it, and backfill. This is labour intensive. It also has the disadvantage that normal use of the ground where the pipes are laid is interrupted for a relatively long period of time. Consequently there has been an increasing use of methods of trenchless pipe-laying, achieved by boring a horizontal hole and drawing the pipe along it.

A number of types of machinery for trenchless pipe laying are currently in use. Generally they take the form of a wheeled trolley which holds a ram or other boring mechanism. A boring head is forced into the ground from above at a shallow angle, and a steering device is used to bring the boring to horizontality when the intended depth has been reached. As boring progresses, work must be interrupted from time to time to attach a new length of drill rod to the string. This is done by hand. Disadvantages that have arisen from existing equipment include:

Difficulties arising from the need to accurately locate the drilling equipment in the desired starting position. The equipment needs to be pulled or pushed by a motor vehicle or manually which increases the setting-up time. In addition if the locating has to be carried out in a busy street it can be dangerous to manoeuvre the equipment without holding up traffic.

Having to manually manipulate lengths of drill rod while drilling into, and removing them when withdrawing from the hole. This is time consuming. Furthermore the necessary manipulation of the drill rods obliges the operator to be in close proximity to the working parts of the drilling mechanism, with attendant risks of accident.

The need for the operator to undertake manual operations involves them in being exposed to the weather conditions as well as physically demanding activities and to the mud resulting from such operations. Such conditions are not conducive to high quality work. They also prevent the operator from paying close attention at all times to what is going on around him.

These and other factors have lead to limitations in size and power and machines in current use are generally limited to bores of about 200 mm diameter.

SUMMARY

The present invention is intended to avoid the disadvantages of current machines and to provide for the ready drilling of holes of up to about 350 mm diameter, although the actual diameter achievable will vary according to the ground conditions.

According to a first aspect of the present invention there is provided a method of drilling a generally horizontally bore comprises the steps of:

1. excavating a given length of trench having a longitudinal axis approximating in direction to that the initial direction of the bore;
2. locating a self propelled chassis over the trench;
3. lowering into the trench from the chassis a thrust chamber which occupies most if not all of the given length;
4. causing a ram to urge a drill head forwardly from the thrust chamber along the path of bore by way of a drill connection comprising at least one drill rod serving to demountably couple the drill head to a motive power unit associated with the chassis;
5. enabling the motive power unit to energise the drill head by way of the drill connection to excavate the bore;
6. periodically temporarily stopping the enabling step and damping the drill connection at a point adjacent the trench;
7. disconnecting the ram from last drill rod in the drill connection;
8. transferring by automatic transfer a further drill rod to the drill connection from an indexed supply of such rods located on the chassis;
9. coupling demountably one end of the further drill rod to the drill connection;
10. connecting the ram to the other end to the one end of the further drill rod;
11. unclamping the drill connection; and
12. resuming the enabling step so that the motive power unit powers the drill by way of the drill connection now extended by the further drill rod.

According to a second aspect of the present invention there is provided a drilling machine for substantially horizontal boring comprising:

1. a chassis including means for self propulsion;
2. a thrust chamber mounted on the chassis for displacement between an extended position wherein the thrust chamber is located beneath the chassis and a housed position wherein the chassis can move relatively freely;
3. a prime mover to enable a drill connection to transmit driving power from the prime mover to a drilling head demountably coupled to the prime mover by way of a driving connection extending through the thrust chamber;
4. the driving connection comprising a plurality of drill rods demountably coupled end to end;
5. a magazine for a plurality of single drill rods enabling the plurality to be stored on the chassis;
6. a ram for demountable connection to the one end of the drill connection to enable the drill to be displaced by the other end of the drill connection to the one end along a path for a bore extending from the thrust chamber;
7. a clamp to enable the one end of the drill connection, or a part of the connection near the one end, to be damped to enable the ram to disconnected from the one end; and
8. transfer means whereby a drill rod can be withdrawn from the magazine and located at the one end of the drill connection fro demountable connection thereto so as to extend the overall length of the drill connection at least when the ram is disconnected from the one end.

In a first preferred version of the second aspect of the present invention the machine includes control means to enable a subsequent path of the drill, and so of the bore it produces, to be varied from an earlier path.

The drilling machine of the present invention serves to provide a massive structural frame containing within it a module referred to as the thrust chamber and which holds the boring mechanism. The machine is self-propelled on caterpillar tracks. In use the drilling machine is driven over a pre-dug launch pit into which the thrust chamber is lowered. When boring has progressed a distance corresponding to the length of a drill rod, an automatic mechanism clamps the working rod in its forward position, moves the ram back, brings another length of rod from a magazine, puts it into place connected to the working rod, and releases the clamp to enable boring to be resumed.

When the drill string is to be withdrawn from the hole, the same procedure operates automatically in reverse, uncoupling a drill rod and replacing it in the magazine.

An exemplary embodiment of the invention will now be described with reference to the accompanying drawing of which:

FIG. 1 show in outline a drilling machine according to the present invention; and FIG. 2 shows a general view of the drilling machine described in connection with FIG. 1 in use.

DESCRIPTION OF THE PREFERRED EMBODIMENTS

FIG. 1

Figure 1:
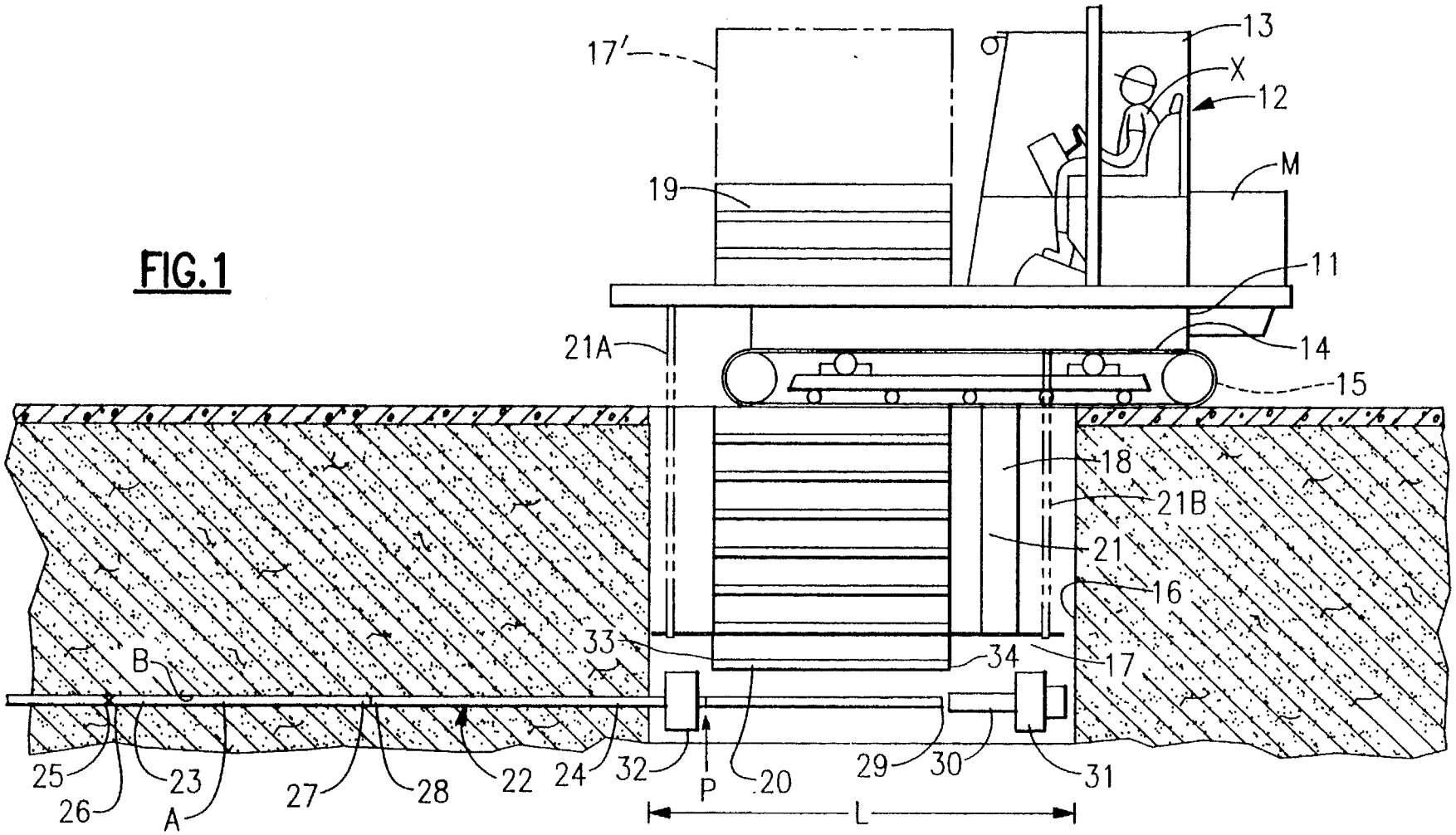

Chassis 11 of drilling machine 12 is equipped with an operating cab 13 from which the machine be driven and manoeuvred to provide for the accurate location of the machine and from where the boring operation can be controlled once the machine is located.

Caterpillar track 14 together with a second parallel track 15 on the opposite side of the machine are more effective than wheels for gaining access to a typical working site and serve to minimise the risk of damage to the walls of launch pit 16 or of sinking into it. The tracks 14, 15 are driven in a known manner by a prime mover M whose operation is controlled from cab 13 by operator X.

The launch pit 16 is readily dug by conventional earth moving machinery and is of relatively short length L with a longitudinal axis A which lies in the general direction of a proposed bore B to be drilled by means of the machine 12.

The chassis 11 can provide means for varying the spacing between tracks 14, 15 so as to accommodate a range of sizes of hunch pit.

A thrust chamber 17 is mounted on the chassis and is shown in its extended position downwardly within the launch pit 16. For moving between sites the thrust chamber can be drawn up by way of hydraulic ram 18 to a raised position 17' (shown in broken outline).

A magazine 19 serves to house drill rods, typically rod 20, vertically above the downwardly extended thrust chamber 17. A transfer mechanism 21 provides for moving rods from their location in magazine 19 and their coupling to drill connection 22 made up of a Fair of drill rods 23, 24. The transfer mechanism 21 is made up of two endless bands 21A, 21B adapted to support each drill rod in a parallel and horizontal configuration. A drive serves to move the belts in identical motion to provide for each drill rod in turn at the bottom of the trench in alignment with the outboard end of the drill connection 22.

A drill head 25 with drill rod 25 is shown having driven to cut part way along bore B. The drill rod 25B is attached to one end 26 of drill rod 23 whose other end 27 is demountably coupled to one end 28 of drill rod 24 whose other end 29 is demountably coupled to a driving head 30 of hydraulic ram 31 whereby the drill head 25 is driven along the path of bore B by way of drill connection 22. The driving head 30 is shown at the start of its path connected to drill rod 24.

Once the driving head has passed along the length of the launch trench to about the position P the coupling between end 29 and head 50 is disconnected by first locking the drill rod 24 by clamp 32 against rotation arising from torque reaction occurring in the length of drill connection in the bore B. The rod end 29 is then disconnected from head 30 and the ram operated to draw driving head 30 back to its starting position as shown in FIG. 1. The transfer mechanism 21 is then operated to move rod 20 from its location in the magazine 19 into alignment with and between the outboard end of connection 22 and the driving head 30. End 33 of the rod 20 is then coupled to end 29 of rod 24. End 34 of the rod 20 is coupled to head 30. The clamp 32 is then released. The drill connection 22 having been lengthened by the length of the rod 20 is then rotated by a power take off from the prime mover M to enable the drill head 25 continue boring along axis B. At the same time the ram is operated to drive head 30 to push the drill connection 22, and so the drill, along the bore B.

The invention is not limited to any specific boring method, but in our preferred embodiment we use hydraulic rams to force the drill into the ground. The drill head may be located and guided by standard known methods from an operating panel 38 in cab 13.

FIG. 2

This shows the drilling machine 12 in use on a roadway 13 providing for the installation of a cable 50 temporarily stored in a drum 51. Drilling is being undertaken between the short launch pit 16 and a short recovery pit 52. Drill head 25 is shown well over haft way along the proposed bore path 53. The exact location of the drill head 25 is sensed by a portable locator 54 whose operator 55 can readily indicate to the drilling machine operator 56 the direction of travel of the head 25. In the event the drill head 25 starts to stray from the required path 53 the operator 56 can make use of conventional techniques to restore the direction of travel of the drill head 25. The machine operator being located in cab 13 is protected from weather, is enabled to clearly view the operator 55 and can monitor the operation of the drilling equipment in the thrust chamber.

Once the drill head 25 breaks through the side wall of the recovery pit 52 the drilling operation is reversed to draw the drill head 25 back along the now completed bore 53 by way of the drill connection 22. The length of the drill connection 22 is progressively reduced in the reverse manner to the way in which it was extended. The transfer mechanism 21 serving to lift uncoupled rods from the drill connection back into the magazine 19.

The cable 50 is then drawn through the bore 53.

It will be apparent that the disturbance of the surface above the bore 53 is kept to a minimum during the drilling operation. The only requirement is that the ground should be sufficiently clear to enable operator 55 to readily monitor the progress of the drill head 25 as it drills out the bore.

Figure 2:
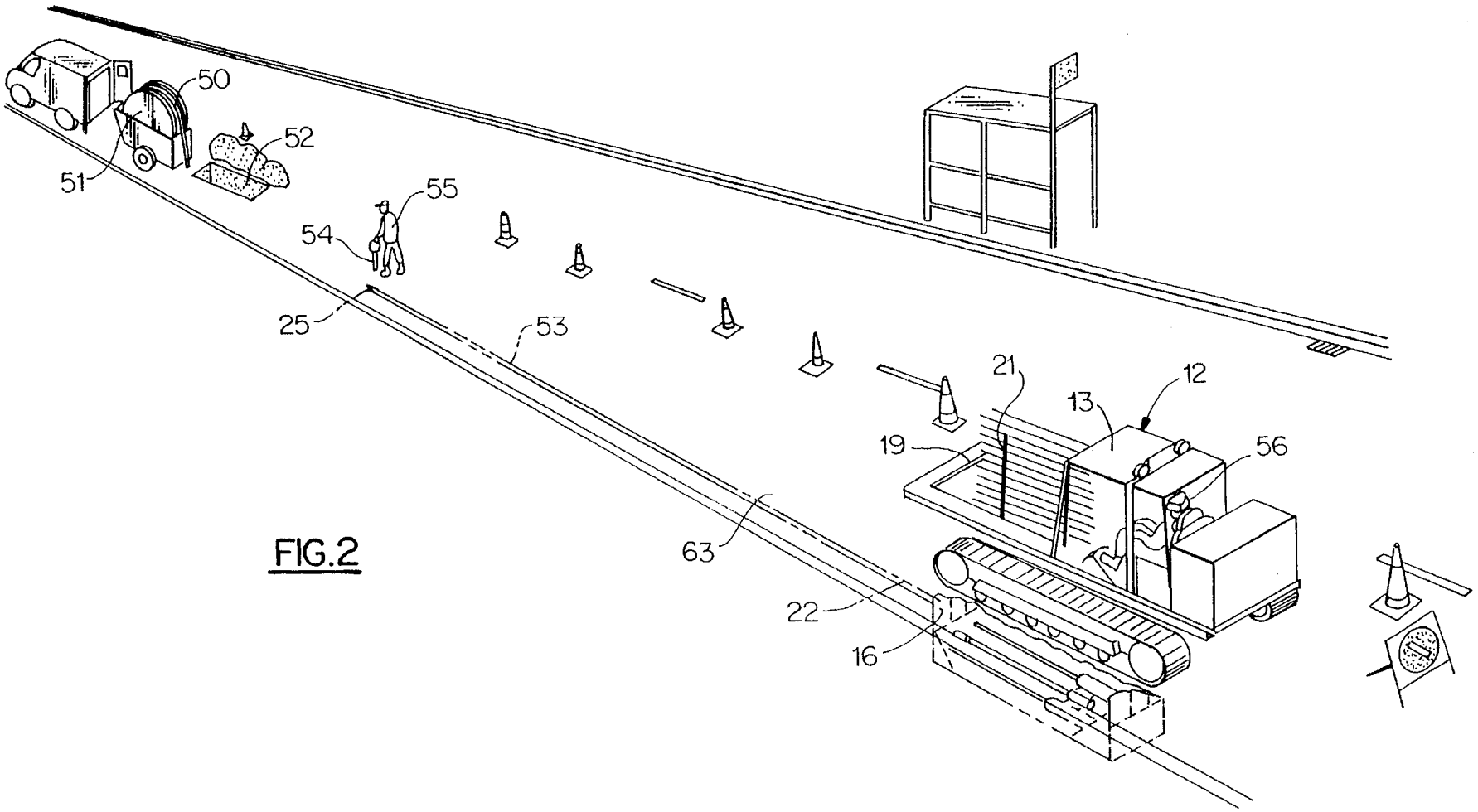

It will be apparent that the drilling machine described enables the drilling operator to maintain control of the operation while remaining under cover. In addition the self propulsion of the machine by way of the caterpillar tracks 14, 15 enable the machine to readily and accurately locate the machine over the launch pit. The level surface shown in FIG. 2 makes the locating of the machine over the trench relatively simple however even in very uneven ground the tracks 14, 15 provide for the ready and accurate location of the machine relative to a trench. In addition in the location portrayed in FIG. 2 by using a self propelled machine the initial setting up process does not require the availability of surrounding space for a towing vehicle or a team of people to push and pull an undriven machine into place. The operator is shielded in his cab from any neighbouring hazards while being in a position to readily oversee the area in the vicinity of the machine.

I claim:

1. A drilling machine for substantially horizontal boring comprising:

1. a chassis including means for self propulsion;
2. a thrust chamber mounted on the chassis for displacement between an extended position wherein the thrust chamber is located beneath the chassis and a housed position wherein the chassis can move relatively freely;
3. a prime mover to enable a drill connection to transmit driving power from the prime mover to a drilling head demountably coupled to the prime mover by way of a driving connection extending through the thrust chamber;
4. the driving connection comprising a plurality of drill rods demountably coupled end to end;
5. a magazine for a plurality of single drill rods enabling the plurality to be stored on the chassis;
6. a ram for demountable connection to the one end of the drill connection to enable the drill to be displaced by the other end of the drill connection to the one end along a path for a bore extending from the thrust chamber,
7. a clamp to enable the one end of the drill connection, or a part of the connection near the one end, to be clamped to enable the ram to disconnected from the one end; and
8. transfer means whereby a drill rod can be withdrawn from the magazine and located at the one end of the drill connection for demountable connection thereto so as to extend the overall length of the drill connection at least when the ram is disconnected from the one end.

2. A method of drilling a generally horizontal bore comprising the steps of:

excavating a given length of trench having a longitudinal axis approximating in direction to that of the initial direction of the bore;

locating a self propelled chassis over the trench;

lowering into the trench from the chassis a thrust chamber which occupies a substantial portion of the given length;

causing a ram to urge a drill head forwardly from the thrust chamber along the path of the bore by way of a drill connection comprising at least one drill rod serving to demountably couple the drill head to a motive power unit associated with the chassis;

enabling the motive power unit to energize the drill head by way of the drill connection to excavate the bore;

periodically temporarily stopping the enabling step and clamping the drill connection at a point adjacent the trench;

disconnecting the ram from a last drill rod in the drill connection;

transferring by automatic transfer a further drill rod to the drill connection from an indexed supply of such rods located on the chassis;

coupling demountably one end of the further drill rod to the drill connection;

connecting the ram to the other end of the further drill rod;

unclamping the drill connection; and resuming the enabling step so that the motive power unit powers the drill by way of the drill connection now extended by the further drill rod.

* * * * *